US007765777B2

(12) United States Patent
Waldron

(10) Patent No.: US 7,765,777 B2
(45) **Date of Patent: *Aug. 3, 2010**

(54) DEVICES FOR INTRODUCING AIR INTO, OR REMOVING AIR FROM, CONTAINERS

(76) Inventor: Joseph M. Waldron, 8522 SW. 1st Pl., Gainesville, FL (US) 32607

( * ) Notice: Subject to any disclaimer, the term of this patent is extended or adjusted under 35 U.S.C. 154(b) by 96 days.

This patent is subject to a terminal disclaimer.

(21) Appl. No.: 12/022,594

(22) Filed: Jan. 30, 2008

(65) Prior Publication Data

US 2008/0179557 A1 Jul. 31, 2008

Related U.S. Application Data

(63) Continuation of application No. 11/385,219, filed on Mar. 21, 2006, now Pat. No. 7,325,381, which is a continuation-in-part of application No. 11/224,506, filed on Sep. 12, 2005, now Pat. No. 7,328,548.

(51) Int. Cl.

| | |
|---|---|
| ***B65B 31/06*** | (2006.01) |
| ***B65B 31/04*** | (2006.01) |
| ***B65D 81/20*** | (2006.01) |
| ***F16K 51/00*** | (2006.01) |

(52) U.S. Cl. ..... 53/510; 53/512; 141/65; 141/66; 206/524.8; 215/262; 215/307; 220/231; 220/745; 220/DIG. 27; 383/3; 383/96; 383/103; 137/903; 251/149.1

(58) Field of Classification Search ..... 53/432–434, 53/510–512; 215/262, 307, 228; 220/231, 220/360, 367.1, DIG. 27, 212, 913, 745–750; 383/3, 96, 103; 251/149.1; 137/903; 141/65, 141/66; 206/524.8; *B65B 31/06*

See application file for complete search history.

(56) References Cited

U.S. PATENT DOCUMENTS

| | | | | |
|---|---|---|---|---|
| 2,412,169 | A * | 12/1946 | O'Neil | 53/432 |
| 2,677,388 | A | 5/1954 | Neff | |
| 2,764,859 | A * | 10/1956 | Hanselmann | 53/434 |
| 3,414,140 | A * | 12/1968 | Feldkamp | 383/3 |
| 3,742,994 | A * | 7/1973 | Pensak | 383/3 |
| 3,943,987 | A * | 3/1976 | Rossi | 206/524.8 |
| RE32,354 | E | 2/1987 | Savage | |
| 4,754,595 | A * | 7/1988 | Sanderson | 53/434 |
| 4,996,848 | A * | 3/1991 | Nelson et al. | 53/434 |
| 5,031,785 | A * | 7/1991 | Lemme | 215/228 |
| 5,121,590 | A * | 6/1992 | Scanlan | 53/510 |
| 5,228,271 | A | 7/1993 | Wallace | |

(Continued)

FOREIGN PATENT DOCUMENTS

JP 05124656 A * 5/1993

*Primary Examiner*—Stephen F Gerrity
(74) *Attorney, Agent, or Firm*—Ballard Spahr LLP

(57) ABSTRACT

Devices comprising a plug positioned within a housing to regulate air within a container, for example, plastic storage containers or bags. One embodiment utilizes a plug that occludes an opening in a housing. The plug is displaced from the opening to inject or evacuate air from a container. An alternative embodiment utilizes a plug having air channels therein which can be sealed once air has been injected into or evacuated from a container. The devices are utilized with hose adaptors connected to vacuum or air hoses having specialized hose tips for coupling with the housing.

15 Claims, 5 Drawing Sheets

U.S. PATENT DOCUMENTS 5,240,112 A 8/1993 Newburger
5,332,095 A 7/1994 Wu
5,413,230 A 5/1995 Folter et al.
5,450,963 A 9/1995 Carson
5,467,806 A * 11/1995 Stricklin et al. ..... 251/149.1
5,513,480 A * 5/1996 Tsoi ..... 53/510
5,540,557 A * 7/1996 Carson ..... 53/510
5,606,988 A 3/1997 Pawlowski, Jr.
5,818,059 A 10/1998 Coyne et al.
5,996,800 A 12/1999 Pratt
6,039,182 A 3/2000 Light
6,059,457 A 5/2000 Sprehe et al.
6,070,397 A 6/2000 Bachhuber
6,155,027 A * 12/2000 Brooks ..... 53/434
6,581,641 B2 * 6/2003 Skeens et al. ..... 251/149.1
6,604,634 B2 8/2003 Su
6,634,384 B2 10/2003 Skeens et al.
6,637,939 B2 10/2003 Huffer
6,712,334 B2 3/2004 Motonaka et al.
6,964,519 B2 11/2005 ErkenBrack
7,036,988 B2 * 5/2006 Olechowski ..... 383/103
7,093,612 B2 8/2006 Greene et al.
7,325,381 B2 * 2/2008 Waldron ..... 53/432
2003/0020040 A1 1/2003 Anderson
2003/0111121 A1 6/2003 Skeens et al.
2004/0114837 A1 6/2004 Koyanagi
2005/0172577 A1 * 8/2005 Oltrogge ..... 53/434
2006/0048483 A1 * 3/2006 Tilman et al. ..... 53/434
2006/0182371 A1 * 8/2006 Borchardt ..... 53/434

* cited by examiner 22
18
16
14

30

29
28

20
18
16
22
14

32
30

29
28
26

DEVICES FOR INTRODUCING AIR INTO, OR REMOVING AIR FROM, CONTAINERS

CROSS-REFERENCE TO RELATED APPLICATION(S)

This application is a continuation application of co-pending application U.S. Ser. No. 11/385,219, filed Mar. 21, 2006, now U.S. Pat. No. 7,325,381, which is a continuation-in-part application of co-pending application U.S. Ser. No. 11/224,506, filed Sep. 12, 2005, now U.S. Pat. No. 7,328,548, each of which is incorporated herein in their entirety, including any figures, tables, and drawings.

BACKGROUND OF INVENTION

It is often desirable when packing and storing materials to reduce the amount of space within the packing containers or bags. Often, the storage space can be reduced by reducing or eliminating the amount of ambient air or other gases within the container or bag. It may also be desirable to remove the ambient air or other gases from containers in order to preserve the integrity or freshness of the packed materials. Conversely, it may be desirable to inflate containers, for example bags, with ambient air or other gases.

The device of the subject invention provides a means for evacuating or injecting air into a variety of containers. The device of the subject invention can be used with containers that may not already have a means for evacuating or injecting air. Thus, a variety of containers, for example disposable plastic wear or various storage bags can be provided with vacuum packing capabilities or inflation with various gases or ambient air.

BRIEF SUMMARY

The embodiments of the subject invention provide means for controlling the amount of air or other gases (herein referred to generally as "air") in a container. This can include evacuating air from or injecting air into a container.

The subject invention comprises a system utilizing a valve mechanism combined with a pump having a hose with a hose adaptor thereon. The hose adaptor is specially designed to work with the valve mechanism to inject air into or evacuate air from a container.

Specifically, the device utilizes a plug positioned within a housing, wherein the housing can be attached to a wall inside a container. The housing can have one or more openings that are occluded by the plug within the housing. To evacuate or inject air into the container, a hole is created in the wall of the container over, or in the vicinity of, the opening in the housing. A vacuum hose or air hose with a rigid or semi-rigid hose adaptor attached is inserted into the hole in the container and through the hole in the housing. The hose tip on the hose adaptor, upon insertion into the hole in the housing, displaces or slightly dislodges the plug from around the opening, thus allowing air to be evacuated or injected through the housing and into the container.

An alternative embodiment comprises a sealable plug mechanism with at least one air channel there through combined with a pump having a hose with a hose adaptor thereon. The hose adaptor includes a means, for example, a heating element, for sealing the at least one air channel in the plug after the injection of or the evacuation of air from a container.

This alternative embodiment can further comprise a housing with an opening occluded by a plug having one or more air channels there through. Alternatively, the housing and plug mechanism can be formed as a single unit from the same or similar material. When the housing is attached to a container, the at least one air channel allows air flow between the inside of a container and the housing. A vacuum hose or air hose with a hose adaptor end is inserted into the housing to remove or inject air. After a container is inflated or evacuated, and before the hose is removed from the housing, a means for heating the tip of the hose, or a device thereon, can be activated. Thus, in this embodiment, the top of the plug is melted, at the appropriate temperature, forming a seal over the one or more air channels so that the hose can be removed from the housing without affecting the achieved condition (inserted air or removed air) of the container.

DETAILED DISCLOSURE

The subject invention provides devices and methods for controlling the amount of air within a container. This can include the evacuation or injection of ambient air or other gases (herein referred to as "air") into or out of various types of containers.

The subject invention provides devices designed to be attached to a container in order to provide one or more openings through which the flow of air can be controlled into and out of the container, preferably after the container has been closed or sealed. The devices of the subject invention can be modified for use with almost any type of container. For example, containers of thin plastic with firm walls or lids can be utilized with the subject invention, for example, but not limited to, Ziploc™ or Glad™ brand storage containers.

The devices of subject invention are particularly useful with air-tight bag-like containers comprising relatively thin, flexible material, for example plastic, rubber, fabric, paper, etc. In a preferred embodiment, the devices of the subject invention are utilized with self-sealing storage bags, for example, but not limited to Ziploc™ or Glad™ brand self-sealing or zipper-closing bags. When sealed, these types of storage bags create an air-tight chamber. When a device of the subject invention is affixed to such a bag, air can be evacuated to create a vacuum or partial vacuum within the bag. Conversely, the devices can also allow air to be injected into a bag.

The devices of the subject invention in general, comprise a plug within a hollow housing, wherein the housing can be connected to an air vacuum or injection source. The housing can further be used to connect the device to a container, preferably to a wall or a lid, and, can also aid in ensuring an air-tight seal with a container.

Figure 4:
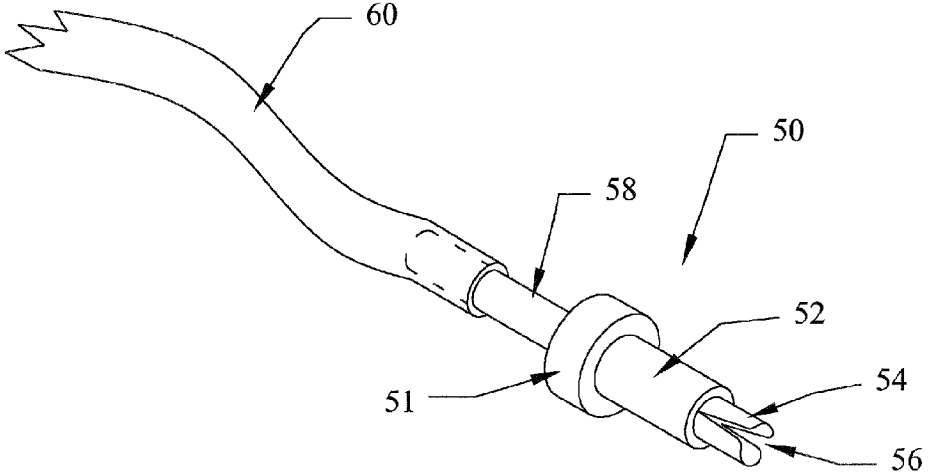
FIG. 4 is an isometric view of one embodiment of a vacuum or air hose tip that can be used with the subject invention.

In one embodiment, a specially designed hose adaptor 50, for example as shown in FIG. 4, is attached to the end of a vacuum or air hose that is connected to a vacuum or air pump means. An opening or hole is created over or near the port hole 16 before or after attachment of the subject invention to the inside of a container. The hose adaptor 50 has a hose tip 54 that, for example as in FIG. 4, can be inserted through the opening created in the container and into the port hole. Upon insertion, the hose tip 54 displaces the tip of the plug away from the port hole. Once the plug is displaced, air can be evacuated from, or, alternatively, injected or blown into, the container, through the housing and into or out of the punctured hole.

In an alternative embodiment, the housing comprises a porthole into which an alternative hose adaptor can be inserted, wherein the housing also comprises at least one vent at the bottom or base of the housing. In this embodiment, a plug or similar device occludes the one or more openings at the base of the housing and further comprises at least one opening or channel there through, such that movement of air into or out of the container is accomplished through the at least one air channel in the plug. In an alternative embodiment, the housing and plug device comprise a single unit wherein the plug device and housing comprise the same, or similar material.

Figure 7:
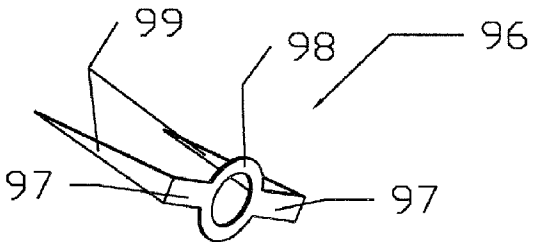
FIG. 7 is an isometric view of a heating element utilized with an alternative embodiment of the air or vacuum hose of the subject invention.
Figure 8:
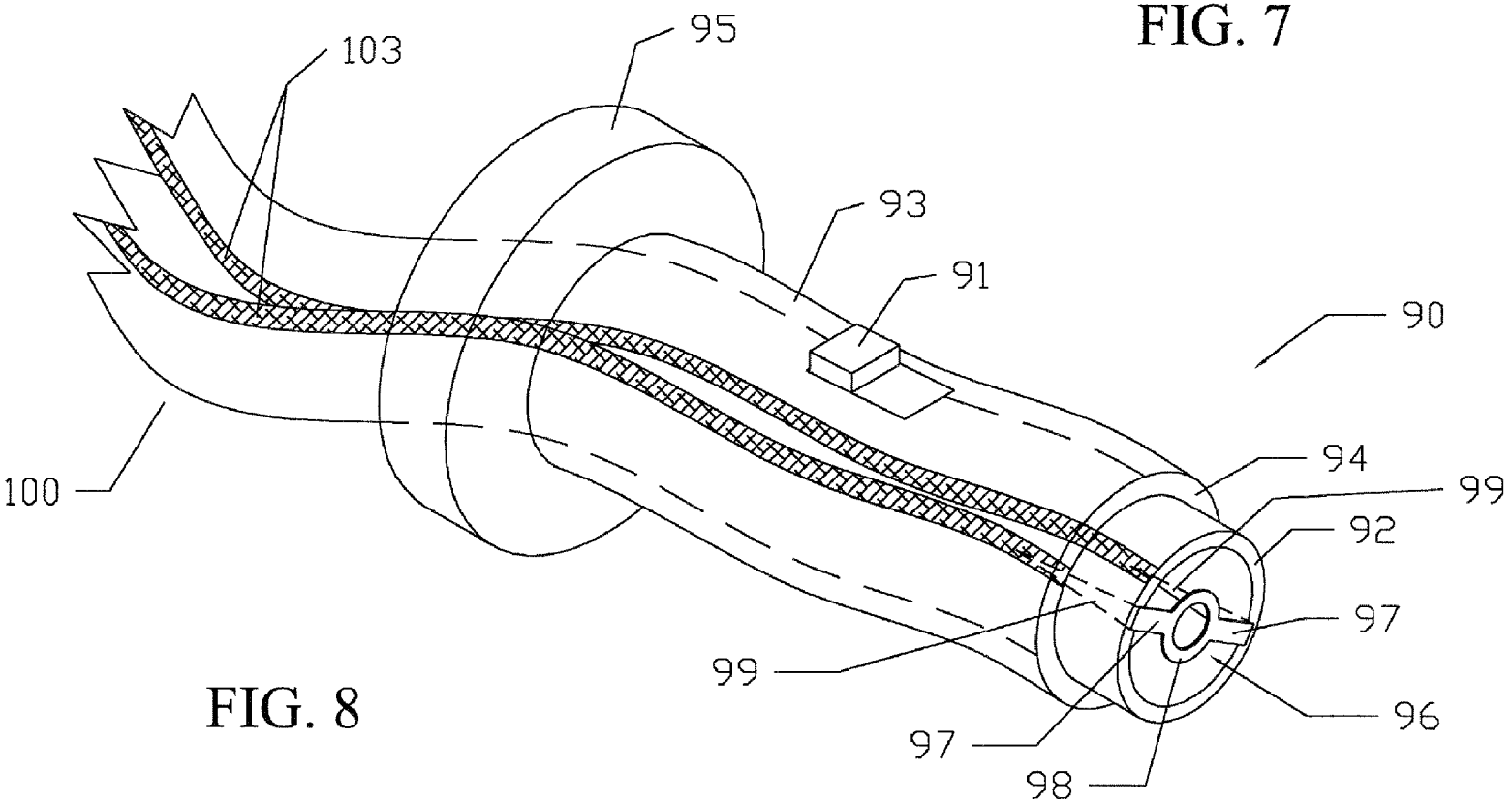
FIG. 8 is an isometric view of a heating element affixed to an air or vacuum hose utilized with an alternative embodiment of the subject invention.

For this alternative embodiment, a further alternative embodiment of the hose adaptor is utilized comprising a heating device, or heating element, for example as shown in FIGS. 7 and 8. Upon insertion of this alternative hose adaptor into the alternative housing embodiment, air can be injected into or evacuated from a container via the air channels in the plug. Once the container has reached the desired vacuum or inflation, the heating device on the hose adaptor can be triggered to heat to a temperature sufficient to melt the top of the plug and seal the air channels. Sealing the air channels prevents any further injection or evacuation of air from the container through the melted plug. Alternative embodiments may utilize sealants or adhesives expelled or ejected from the hose adaptor to seal the air channels.

Figures 1A, 1B, 1C, 1D, 1E, 1F:
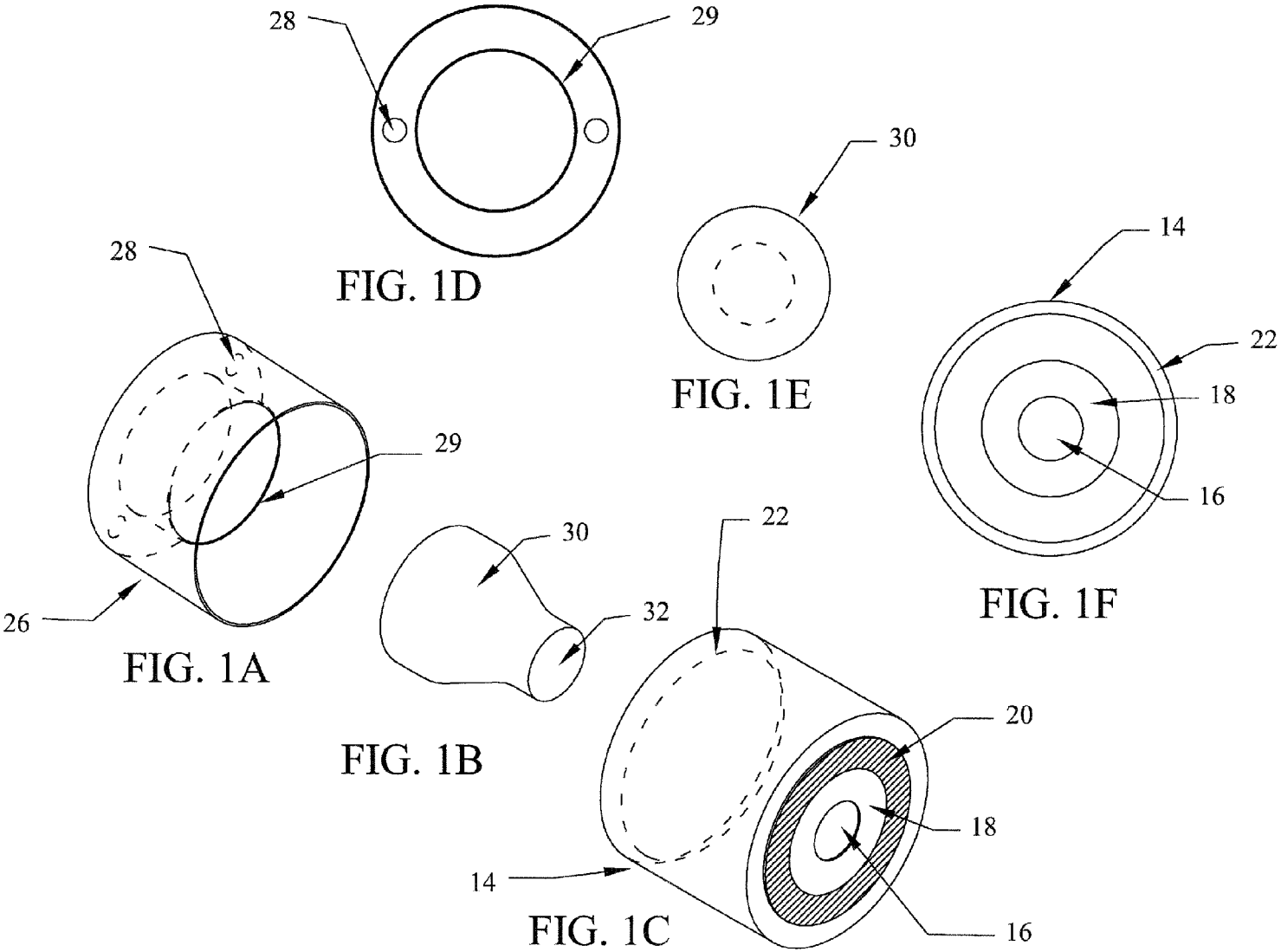
FIG. 1A shows an isometric view of the housing base of one embodiment of the subject invention.
FIG. 1B shows an isometric view of a plug that can be utilized within the housing of one embodiment of the subject invention.
FIG. 1C shows an isometric view of an example cap of a housing having a port hole through which a plug regulates the flow of air in one embodiment of the subject invention.
FIG. 1D is a plan view of the example base of the housing shown in FIG. 1A, as viewed from the open end.
FIG. 1E is a plan view of the example plug shown in FIG. 1B, as viewed from the bottom end.
FIG. 1F is a plan view of the example cap shown in FIG. 1C, as viewed from the open end opposite the port hole.
Figure 6A:
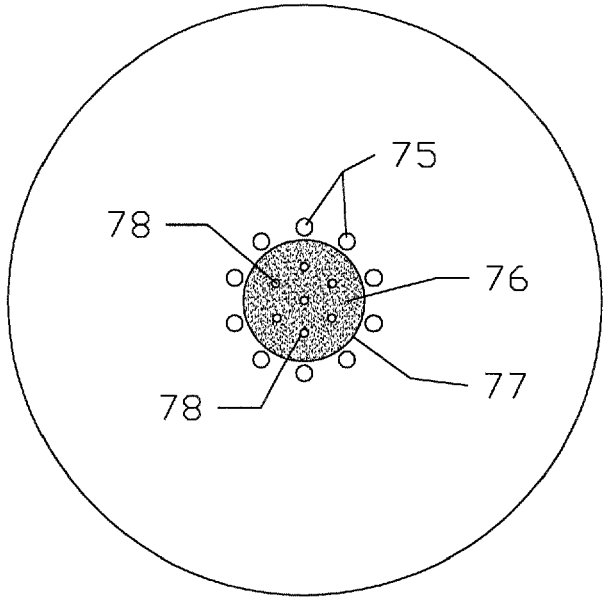
FIG. 6A is a plan view of the underside side of an alternative embodiment of the subject invention.
Figure 6B:
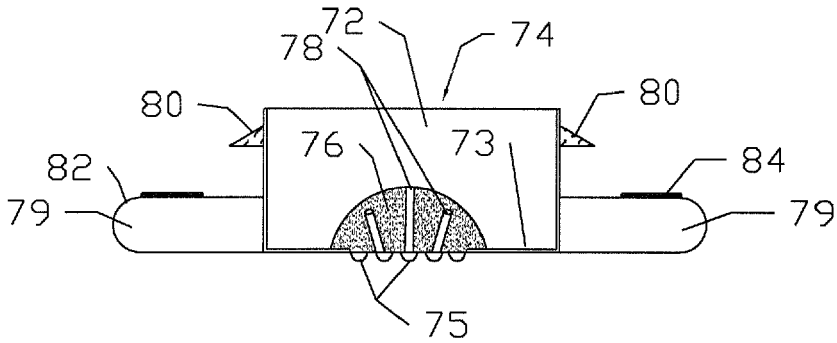
FIG. 6B is a cross-sectional side view of an alternative embodiment of the subject invention. This figure includes examples of a pawl and washer, as well as adhesive strip components. Also shown are the air channels in the base of the housing.

As mentioned above, the housing 12 embodiments of the subject invention are essentially chambers that contain plugs 30 or similar devices for example as shown in FIG. 1B or 6B. The housings can be made as one or more pieces that, when attached, form an essentially air-tight seal around an opening in the container through which air will be evacuated or injected. The housing of these embodiments can be a variety of shapes and sizes, which could depend upon the size and shape of the container to which it will be connected. The housing 12 of these embodiments may also be made of a variety of materials, which, again, could depend upon the type of container to which the housing will be attached. For example, if the devices of the subject invention are used in food storage containers, it may be preferable for the devices to be microwaveable or oven-safe. Conversely, if the device is to be used on containers designed for freezer storage, it may be preferable to use freezer-safe materials. Thus, many types of microwave or oven-safe materials could be used, such as, for example, various plastics, rubbers, glass, metal, or alloys thereof, etc. As will become apparent after review of the subject application, for certain embodiments, it may be preferable to utilize materials that cannot conduct an electrical current. In addition, the size of the housing will also depend upon the size of the container. The size of the devices may also be dictated by the vacuum source and power thereof.

The devices described herein are shown and described with the means to be affixed to containers at anytime before during or after manufacture. Thus, these devices can be separate from containers and affixed to any desirable wall or surface of a container after manufacture. However, the placement or installation of the devices during manufacture of a container is also construed to be within the embodiments of the subject invention. For example, in one embodiment, the one or more devices of the subject invention can be thermally sealed to any of various types of containers during the manufacturing process.

In one embodiment, the housing comprises two parts, a base 26 and a cap 14, for example, as shown in FIGS. 1A, 1D, 1C and 1F. In this embodiment, the base 26 has a circumference that is smaller than the inside circumference of the cap 14. The base 26 can be slid into or otherwise positioned inside the cap 14 such that the open end of the base 26 faces the port hole 16 in the cap 14. This allows access to the hollow chamber and the plug 30 before the housing is assembled.

The base 26 and the cap 14, as exampled in FIGS. 1A, 1D, 1C and 1F, can be made to fit together using a variety of methods and techniques known in the art. For example, the base 26 and cap 14 may be glued, thermally sealed, or welded, or various snaps can be utilized, etc. It may also be desirable for the base 26 and cap 14 to be removably joined together to allow access to the inside of the housing 12 or to the plug 30, if necessary, before or after installation. In this embodiment, the base 26 and cap 14 could be screwably attached, or various snaps or other means known in the art could be used. In a preferred embodiment, the base 26 and cap 14 are held together by one or more protrusions or snap lips 22 inside the open end of the cap 14. When the base is slid into or positioned within the cap 14, the covered end of the base 26 engages with the one or more snap lips 22 on the inside of the cap, which lodge against the bottom or covered end of the base 26 to hold it in place within the cap 14. A person with skill in the art will recognize that this arrangement could easily be modified so that the lip 22 is positioned along the inside of the cap and can engage with the base via dimples, depressions, or channels into which one or more snap lips 22 can seat when the base 26 is inserted into the cap 14.

In this embodiment, for air to be evacuated or injected into the container to which the device of the subject invention is attached, the housing can have one or more openings or vents 28. These vents 28 can be provided anywhere on the housing, in the cap 14 or the base 26. However, it may be preferable to provide openings in such a way that they will not be closed or otherwise interfered with by the materials within the container or by the container itself. In a preferred embodiment, one or more vents 28 are positioned at the bottom or covered end of the base 26, for example as shown in FIGS. 1A and 1D. The openings can be any number, size or shape, but should be sufficient to allow the passage of air into or out of the container. In a further preferred embodiment, the end of the base 26 where the vents are located is curved to create a convex end to the base 26. This convex end raises the vent holes so they are not covered or blocked by the material of the container or the contents therein.

As mentioned previously, the housing 12 contains a plug 30 that occludes the port hole 16 in the cap of the housing. The displacement of the end of the plug 30 away from the port hole 16 by insertion of the hose tip 54, allows air to be evacuated or injected into the container, through the vents 28 and into the housing 12. In order to prevent the entire plug from being displaced within the housing when the hose tip 54 is inserted, the plug 30 can be secured to the inside of the base 26. The plug 30 can be fixedly attached to the base 26 using a variety of techniques known in the art, including glues, thermal sealing, screwing, snapping into place, etc. However, it may be desirable to change, alter or otherwise adjust the plug 30 used in the device of the subject invention. As mentioned previously, depending upon the type of container the device is used with, or the materials therein, it may be necessary to use plugs 30 of different styles, shapes, or materials. Thus, in a preferred embodiment, the plug is removably attached to the base 26. In a further preferred embodiment, a plug seat 29 is positioned inside the base on the bottom or closed end, for example as shown in FIGS. 1A and 1D. In a still further preferred embodiment, plug 30 is seated within and held in place by the plug seat 29. When the base 26, with the plug 30 in place within the plug seat 29, is positioned inside the cap 14, the top of the plug becomes pressed against, and occludes, the port hole 16. In a further preferred embodiment, the plug seat 29 is able to maintain the plug in a stable position within the housing 12 even when the top of the plug 30 is displaced by the hose tip 54.

The plug 30 of the device of the subject invention regulates the flow of air into and out of the housing 12 and, thus, the container to which the device is attached. This embodiment of the subject invention is, preferably, designed to be used multiple times. Therefore, the plug material should be durable, yet flexible with sufficient elastic memory to quickly reposition itself against the port hole 16 numerous times after repeated insertion and removal of the hose tip 54. It may also be necessary to consider the environments to which this embodiment of the device of the subject invention will be subjected during use. High heat applications or severe cold applications may dictate the type of material used for the plug of this embodiment. The plug may also comprise more than one material. For example, the bottom of the plug may be of one material, for example, but not limited to, a rigid plastic material, wood, etc., to which is attached a flexible tip end 32 made of another material, for example, but not limited to, pliable plastics, rubber, silicone, etc. In a preferred embodiment, the plug 30 comprises a rubber-like material that is microwave safe and cold tolerant.

Figure 3:
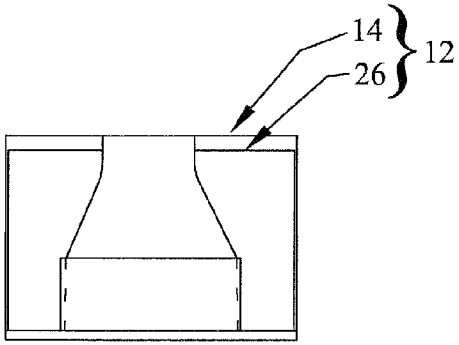
FIG. 3 is an elevational view of one embodiment of the device of the subject invention, wherein the front portion of the housing has been removed to show the interior cavity, an example plug seat, and an example plug.

The circumferential shape of the plug 30 can be any of a variety of shapes, for example, but not limited to, circular, oval, square, triangular, or any other polygonal shape, and may also vary along the length of the plug, if necessary. But, it should be of sufficient length to reach the port hole 16 from the plug seat 29, the base of the housing, or other support structure that may be utilized and have sufficient tension on the port hole 16 to prevent any unwanted passage of air through the port hole 16, as illustrated in FIG. 3. In a preferred embodiment, the plug 30 has a circular circumference along its length. In a further preferred embodiment, the plug 30 is larger at the base end that fits within the plug seat 29, to provide additional stability. In still a further preferred embodiment, the plug 30 tapers towards the tip end 32 that occludes the port hole 16, for example as shown in FIGS. 1B and 1E, such that the circumference of the tip end 32 is smaller than the base end, but is sufficiently large enough to cover the circumference of the port hole 16, as shown in FIG. 3. In an alternative embodiment, the tip end 32 is convex or rounded so that it can more effectively occlude the port hole. Such a convex tip would allow the tip end to protrude slightly into the port hole. This can ensure a complete seal around the port hole by the circumference of the tip end 32.

The cap 14 of the subject invention is connected to the base 26, as discussed above. The cap 14 contains an opening or port hole 16 through which the vacuum or air tube 60 can be inserted. It is the end of the cap 14 with the port hole 16 that attaches to the inside wall of a container. The cap 14 of the subject invention can be attached to a container in a variety of ways known to those with skill in the art. The method of attachment should ensure an essentially air-tight seal so that air cannot enter or escape from the container after the vacuum or air tube is removed from the port hole 16. For example, the cap can be thermally sealed to the container or glued to the container. In one embodiment, the cap is thermally sealed to the container during the manufacturing process. And, in still a further embodiment, during the manufacture of containers, openings can be pre-made in one or more walls or lids of the containers to allow access to the port hole 16 after attachment of the housing of the subject invention to the inside walls of said containers. In a preferred embodiment, a concentric ring of adhesive material 20 surrounds the port hole 16. The ring of adhesive material 20 can be pressed against the wall of the container to attach the housing 12 to the container and to create an air-tight seal around the port hole 16. There are numerous kinds of adhesive that could be utilized with the subject invention. Furthermore, this method of attachment allows the device of the subject invention to be utilized with containers comprising a variety of materials.

Figure 2A:
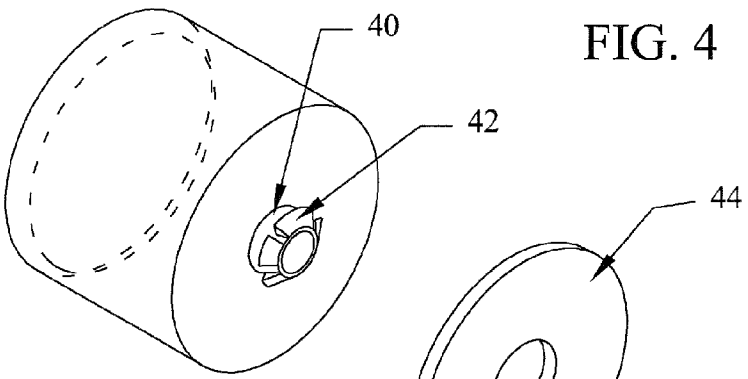
FIG. 2A is an isometric view of an alternative embodiment of a cap that can be utilized with the housing of an embodiment of the subject invention. This embodiment utilizes a lock washer that can be secured to a stem on the cap to hold the device of the subject invention onto a container.
Figure 2B:
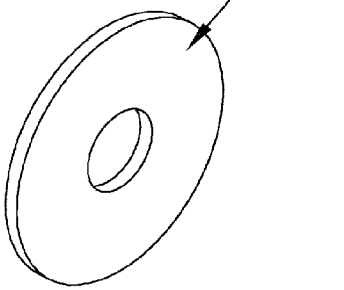
FIG. 2B is an isometric view of an example lock washer that can be used with the embodiment shown in FIG. 2A.

In another embodiment, the port hole 16 may be surrounded by a stem 40 to which are fixedly attached teeth or pawls 42, as shown in FIG. 2A, for receiving and securing a lock washer 44, as shown in FIG. 2B. In operation, the stem 40 is inserted through a hole made in the container so that the wall of the container is pressed against the top of the cap 14 and around the stem 40. Once in position, a lock washer 44 can be pushed or pressed over the pawls 42 on the stem 40. Once the lock washer 44 is pushed far enough, the pawls 42 hold the lock washer in place against the side of the container opposite the top of the cap 14. In this way, the wall of the container becomes pressed between the cap 14, inside the container, and the lock washer 40, on the outside of the container. It can be appreciated that in this embodiment the stem 40 should be of sufficient length to receive the lock washer 44, and the pawls 42 should ensure that it is held securely against the side of the container against the cap so that an air-tight seal can be achieved and maintained.

A person with skill in the art would readily recognize that this arrangement could be modified in a variety of ways. For example, the lock washer 44 and stem 40 could have opposite threading such that the lock washer 44 could be screwed onto the stem 40, or variations thereof. The stem 40 and lock washer 44 means could also be utilized in conjunction with an adhesive, such as the ones described above, or other insulating means or materials that would aid or ensure that an air-tight seal is achieved around the port hole 16. Likewise, the lock washer 44 could be modified to have ridges or other protrusions on one or both sides or around the edges that could be pressed into the surface of the container to aid in securing an air-tight seal when the lock washer is positioned over the stem 40.

In a preferred embodiment, the port hole 16 is located within the cap 14 of the device of the subject invention. The port hole 16 is designed to receive the hose tip 54 on the end of the hose adaptor 50. The port hole 16 is essentially a hole in the cap 14 that can be of various sizes or shapes, depending upon the configuration of the hose adaptor. There may also be more than one port hole, or the port hole can be divided in order to better receive a variety of hose adaptors that can be utilized with the subject invention. In one embodiment the area around the port hole 16 is slightly raised or cupped above the level of the cap end, causing a slightly concave surface within the cap around the port hole. Alternatively, the area within the cap around the port hole 16 can be manufactured with a slightly concave surface without raising the area around the port hole above the level of the cap end. This slight concavity around the port hole 16 can aid in the repositioning of the tip end 32 of the plug to occlude the port hole when it is displaced from around the port hole. As mentioned above, the port hole 16 may be surrounded by a neck or stem 40 to secure the device to a container. One with skill in the art would recognize that the port hole 16 can be modified in a variety of ways in order to properly receive a hose tip 54 or other means for evacuating or injecting air into a container.

In a preferred embodiment, the port hole 16 is a single opening within the top of the cap 14. In a still further preferred embodiment, the material surrounding the port hole 16 is a soft but firm material 18 that can conform to the size and circumferential shape of the hose tip 54.

As mentioned above, an alternative embodiment of the subject invention comprises a housing 72 having a plug 76 occluding an opening 77 in the base 73 of the housing. The plug 76 further comprises one or more channels 78, for example, as shown in FIG. 6B, that traverse the interior of the plug 76 to provide a passage between the interior of the housing 72 and the interior of a container to which the subject invention is attached.

In this alternative embodiment, the housing 72 is essentially a walled aperture that can comprise a variety of circumferential shapes, including, but not limited to, square, circular, oval, triangular, or any other polygonal shape. In a preferred embodiment, the circumferential shape is circular to more easily accommodate standard vacuum or air hoses. In a preferred embodiment, the housing 72 is approximately 0.1 inches to about 0.4 inches tall and approximately 0.4 to about 0.9 inches in diameter. In a more preferred embodiment, the housing 72 is approximately 0.125 to about 0.25 inches tall and approximately 0.5 to about 0.625 inches in diameter.

In another embodiment, the housing and plug comprise a single unit, wherein the housing and plug further comprise the same or similar material. In this embodiment, the plug mechanism is a raised area or dimple-like structure within the floor of the housing through which the air channels traverse. The dimple-like plug structure in this embodiment is of sufficient height to ensure adequate contact with the hose tip, discussed below, and, preferably, avoid contact of the hose tip and/or its means for sealing the air channels, with the floor of the housing.

In use, this alternative embodiment requires that an opening be created in the wall of a container, as previously disclosed, to provide the air channels 78 with access to the interior of the container. Preferably, this allows the walls of the housing 72 to be essentially perpendicular to the wall of the container and the housing mouth 74 opening to the outside of the container. However, alternative embodiments can have housings with alternative shapes or bends that may not necessarily be perpendicular to the walls of a container.

In a preferred embodiment, an air-tight seal is created between the outside wall of the housing and the periphery of the opening in a container. To accomplish this, a variety of techniques known in the art may be utilized. For example, the outside walls of the housing 72 may comprise an adhesive material to which the periphery of the opening in a container may be adhered to form an air-tight seal. Alternatively, the container may be thermally sealed around the walls of the housing 72 to form an air-tight seal.

In a preferred embodiment, the housing 72 of this alternative embodiment of the subject invention further comprises a housing collar 79 around the circumference of the housing 72, for example as shown in FIGS. 5A, and 6A-6C. The housing collar 79 provides alternative means of connecting this alternative embodiment of the device to a container. The housing collar 79 may comprise a variety of circumferential shapes, decorative or otherwise, including, for example, round, square, oval, triangular or any other polygonal shape. Alternatively, the housing collar 79 may comprise one or more sections, such that there may be one or more flange-like protrusions extending from the circumference of the housing 72. The housing collar 79 may further comprise any of one or more materials, which may be the same or different from the material(s) utilized for the housing 72. A person with skill in the art will be able to determine appropriate material(s) for the manufacture of the housing 72 and the housing collar 79. In a still further embodiment, the housing 72 and the collar 79 may be manufactured as a single unit or one or more pieces to be connected. For example, the collar can be manufactured as a separate piece that is capable of being inserted over or pressed over the housing 72. The housing 72 could further comprise a means for ensuring that the collar 79 maintains the appropriate position around the housing 72. By way of example, the outside circumference of the housing 72 could additionally comprise a lip, rib, or other similar structure that can ensure that the collar, once insert, pressed or otherwise positioned around the housing can only extend a desired distance along the length of the housing 72. Other means for securing or limiting motion of the collar will be apparent to a person with skill in the art, and are contemplated to be within the scope of the present invention.

As mentioned above, providing a housing collar 79 around the circumference of the housing 72 allows several options for connecting the device of the subject invention to a container, fixedly or otherwise. For example, the container can be thermally sealed to the device by attaching the circumference of the opening to the exterior of the housing wall 72. However, this may be more easily accomplished by utilizing a housing collar 79 to which the perimeter of the opening in the container can be thermally sealed.

However, in a preferred embodiment, an adhesive material 84 is fixedly connected to the top side of the housing collar 79.

This permits the periphery of the opening created in a container to accommodate the subject device to be adhered to the collar to form an air-tight seal. There are a variety of adhesive materials 84 known to a person with skill in the art that can be utilized with this embodiment. Further, a person with skill in the art will be able to determine the appropriate thickness, range of diameters, position, etc. that would be appropriate for the adhesive material based upon the materials utilized and size of the device of the subject invention, as well as the size, type and expected use of the container to which the device is to be adhered.

Figures 5A, 5B:
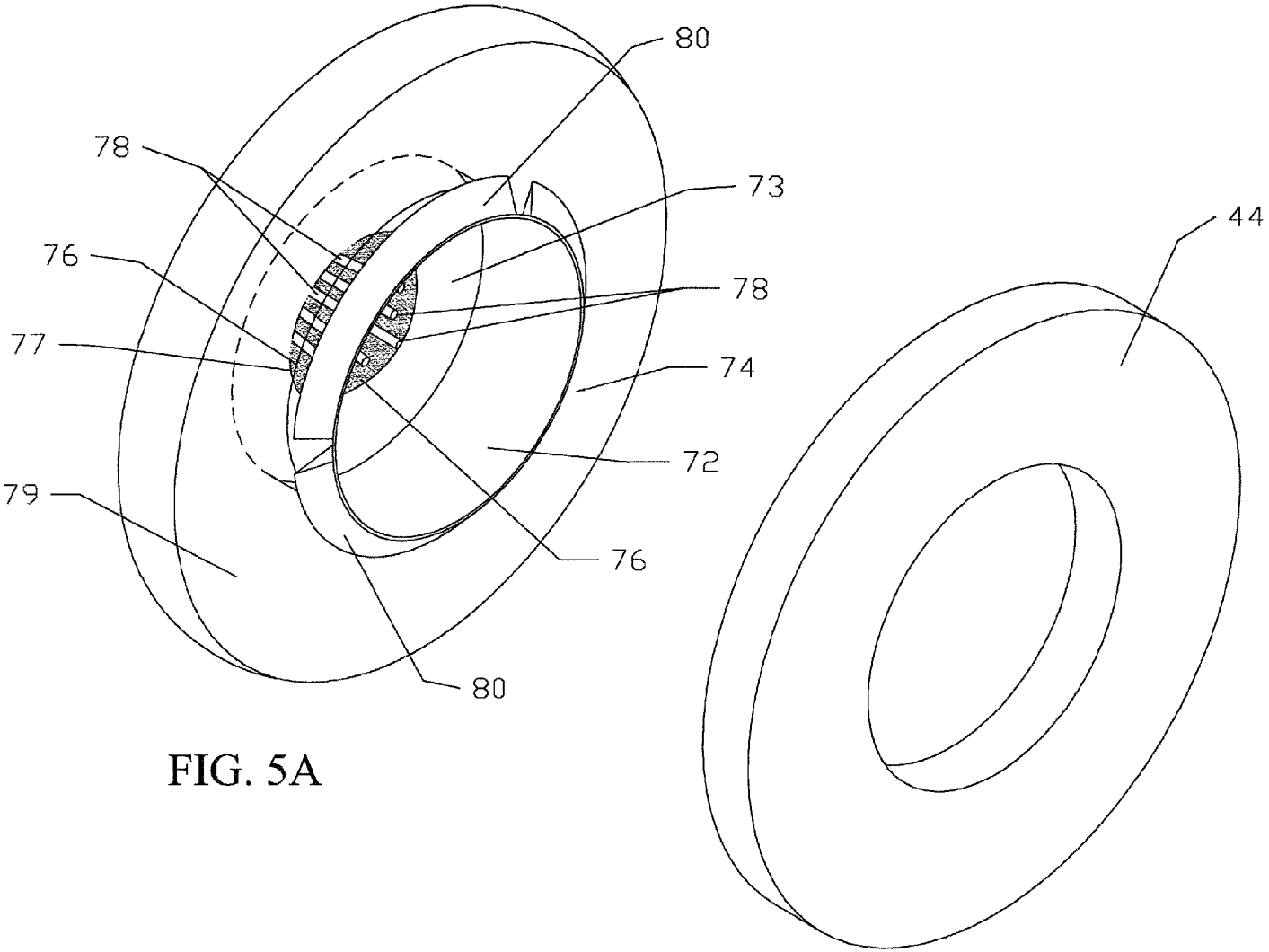
FIG. 5A is an isometric view of an alternative embodiment of the subject invention. This figure includes an example of a pawl and flange component.
FIG. 5B is an isometric view of an example lock washer that can be used with the embodiment shown in FIG. 5A.
Figure 6C:
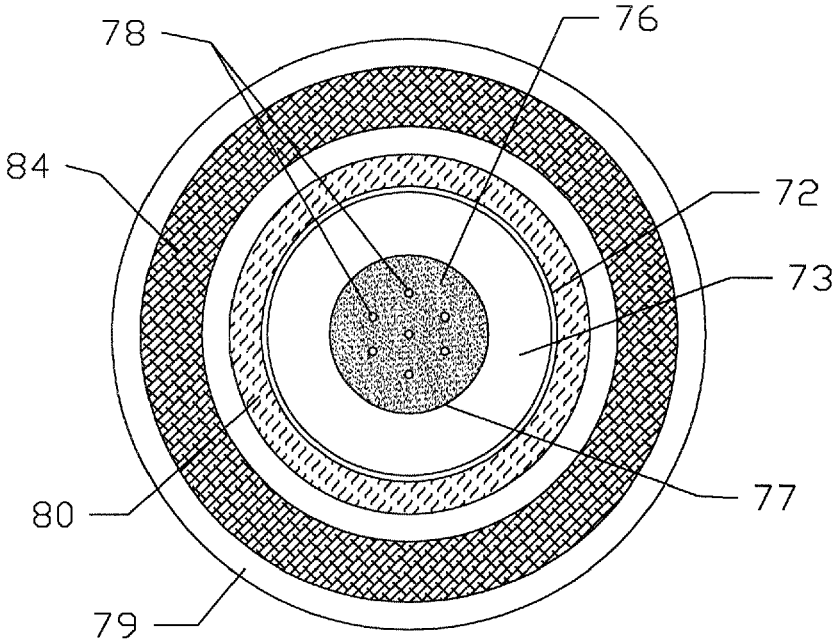
FIG. 6C is a plan view of the top side of an alternative embodiment of the subject invention. This figure includes examples of a pawl and washer, as well as adhesive strip components.

An alternative embodiment can also utilize one or more teeth or pawls 80 positioned around the mouth of the housing 74, for example, as shown in FIGS. 5A, 6B and 6C, designed for receiving and securing a lock washer 44, an example of which is shown in FIG. 5B. With this embodiment, the housing 72 is inserted from the inside of a container to the outside through an opening made in a container, such that the wall on the inside of the container around the opening is pressed against the top side of the housing collar 79. Once in position, a lock washer 82 can be pushed or pressed over the pawls 80, which are able to hold the lock washer in place against the side of the housing collar 79. In this way, the wall of the container becomes sandwiched between the housing collar 79 that is inside the container, and the lock washer 44, located on the outside of the container. As discussed above for previous embodiments, the distance between the pawls 80 and the housing collar 79 should be sufficient to accommodate the thickness of a lock washer 44 and ensure that it is positioned against the wall of a container with enough force or pressure to create and maintain an air-tight seal around the opening.

In addition, as discussed for previous embodiments, a person with skill in the art would readily recognize that this arrangement can be modified in a variety of ways. For example, the lock washer 44 and housing 72 can have opposite threading such that the lock washer 44 can be screwed onto the stem 40, or variations thereof. The housing collar 79 and lock washer 44 of this embodiment can also be utilized in conjunction with an adhesive on the housing collar 79, such as the ones described above, or other insulating means or materials that would aid or ensure that an air-tight seal is achieved around the container opening. Likewise, the lock washer 44 can be modified to have ridges or other protrusions on one or both sides or around the edges that can be pressed into the surface of the container to aid in securing an air-tight seal when the lock washer is positioned over the housing collar 79.

The plug 76 utilized with this alternative embodiment is positioned over and/or within an opening 77 within the housing base 73. The plug may be devised to couple with the opening 77 so as to be removable or exchangeable. This may be accomplished by using various flanges, gaskets, fittings, etc. or other means known to those with skill in the art that will ensure an air tight seal around the plug. However, in a preferred embodiment, the plug is fixedly attached to occlude this opening.

As mentioned previously, in an alternative embodiment, the plug 76 and housing 72 can be a single unit, such that the plug 76 is contiguous with the housing base 73, and are molded of, the same or similar material. In a further alternative embodiment, the plug 76 and housing 72 can be a single unit, such that the plug 76 and housing base 73 comprise different materials that are molded, melded or otherwise joined to form a single unit. It would be well within the skill of a person trained in the art to create alternative housing 72, housing base 73, and plug 76 combinations wherein these components can be separate pieces combined prior to use or formed as a single unit.

The shape and size of the plug can be variable and may depend upon the materials utilized for the plug, or the combined plug and housing, and the means by which it will be secured within or over the opening 77 or shaped as part of the housing base. For example, a plug having a sphere or lozenge shape can be used. In the embodiment utilizing a separate plug device this shape curvature allows it to "seat" into and around the opening 77 to aid in achieving an air-tight seal. Alternatively, the plug can also be somewhat flattened such that it simply covers the opening 77 providing no protrusion into the opening.

In a preferred embodiment, the plug 76 is rounded or oval shaped. In a further preferred embodiment, the plug 76 has a extension on the underside allowing the top side to provide an overhanging edge, thus, giving the plug 76 a somewhat "mushroom" shape, for example as shown in FIG. 6B. In this preferred embodiment, the protrusion or "stem" of the plug 76 is fixedly positioned within the opening 77 in the housing base 73 and the overhanging edge or "cap" of the plug 76 is positioned around and on top of the circumference of the opening 77 preventing the plug 76 from falling through or being pushed through the opening 77.

In a further alternative embodiment, the end of the "stem" of the plug 76 can be flared, or provided with one or more flanges. This flared end or flange extension once pushed through the opening 77 is able to expand around the outer edge of the bottom side of the opening 77, thus preventing the plug from be pulled, pushed or otherwise extracted from the opening 77 and into the housing.

The plug 76 in these alternative embodiments further comprises one or more channels 78, for example as shown in FIGS. 6A-6C that permit the movement of air through the plug. Thus, when the device of the subject invention is placed on a container, air can be evacuated from or injected into a container via these air channels 78. The circumferential shape of the channels can be variable. The length and angles of projection of the channels can also vary depending upon the shape of the plug and the placement of the channels therein. It may also be possible for one or more channels 78 to be combined or joined at some point along their length to modify the flow rate of air into or out of a container. It may further be desirable to have a single enlarged channel. In a preferred embodiment, the plug 76 comprises one or more channels arranged in a circular or semi-circular fashion through the length of the plug 76, for example as shown in FIGS. 6A and 6C.

In this alternative embodiment, the air channels 78 through the plug 76 are designed to be either permanently or temporarily sealed by a specifically designed hose adaptor 90, which will be discussed below. When connected to a container, the specially designed hose adaptor fits within the housing and is, preferably, in contact with or proximal to a sufficient portion of the plug. Upon completion of the injection or evacuation of air from a container, the upper ends of the air channels 78 within the housing 72 are blocked, sealed or otherwise closed. In a preferred embodiment, the hose adaptor 90 will provide the means for closing or sealing the air channels 78. For example, the hose adaptor 90 can have a means to deliver a material that adheres to the plug material and, perhaps, fills or partially fills the air channels 78 to prevent undesired movement of air into or out of a container.

Because the air channels are open to a container cavity, opportunity may exist for the ends of the air channels 78 to become blocked by contents of a container. Therefore, a means to reduce or prevent blockage of the air channels 78 within a container may be advisable. For example, protrusions or partitions near the air channels 78 may prevent articles or material within a container from contacting and obstructing the air channels 78. Thus, in a further preferred embodiment one or more protective knobs 75, for example as shown in FIGS. 6A and 6B, are positioned around the exterior of the housing base. These protective knobs 75 prevent container contents from contacting and blocking the air channels 78, but permit the movement of air into or out of a container.

In a preferred embodiment, the plug comprises a heat deformable material, for example, but not limited to, nylons, polycarbonates, polyesters, polyethylenes, and polypropylenes, or other types of thermoplastic material. In this embodiment, the hose adaptor 90, which will be discussed below, further comprises a means for delivering sufficient heat to melt an adequate portion of the heat deformable plug material so as to deform and permanently seal the air channels 78. It should be understood that it is well within the skill of a person trained in the art to create alternative means for sealing the air channels 78 within a plug 76.

A hose adaptor 50 provides a means for connecting or inserting a vacuum or air hose 60 to the port hole 16, as mentioned in the first embodiment of the subject invention, or into the housing mouth 74, as described in an alternative embodiment. In a first embodiment, the hose adaptor 50, for example as shown in FIG. 4, has a tube 58, or other means, at one end for attaching to a vacuum or air hose. The hose adaptor also has a hose tip 54 that can insert into the port hole 16 within the cap 14 of the subject invention. In a preferred embodiment, the hose tip 54 is sufficiently rigid to displace the plug from the port hole 16 so that air can be evacuated or injected into the housing 12, and, thus, into a container. In a further preferred embodiment, the hose tip 54 has slots or grooves 56 to facilitate air flow through the hose tip 54 and around the plug. An example of a slotted or grooved 56 hose tip 54 is illustrated in FIG. 4.

It can also be advantageous to ensure that the hose tip 54 and the port hole 16 are of similar diameter, such that a snug, essentially air-tight seal can be achieved when the hose tip 54 is inserted into the port hole 16. The hose tip 54 may also comprise or be covered, entirely or partially, with a pliable or semi-pliable material capable of conforming to the shape of the port hole 16 to aid in obtaining a sufficient seal. In a preferred embodiment, the diameter of the hose tip 54 is smaller than the diameter of the port hole 16, but only sufficiently so to allow the hose tip 54 to be inserted into the port hole 16 without damaging the port hole, but still provide a snug, relatively air-tight seal.

In an alternative embodiment, the hose adaptor 90 comprises a hose tip 92 that can be inserted into the housing mouth 74 of the alternative embodiment of the subject invention also discussed above. In a preferred alternative embodiment, the hose tip 92 is sufficiently rigid so as to be easily insertable into the housing mouth 74. It can also be advantageous to ensure that the hose tip 92 and the housing 72 are of compatible diameters, such that a relatively snug, essentially air-tight, seal can be achieved when the hose tip 92 is inserted into, or otherwise covers, the housing mouth 74. The hose tip 54 may also comprise or be covered, entirely or partially, with a pliable or semi-pliable material capable of conforming to the shape of the housing 72 to aid in obtaining a sufficient seal. In a preferred embodiment, the diameter of the hose tip 92 is smaller than the inside diameter of the housing 72, but only sufficiently so to allow the hose tip 92 to be inserted into the housing 72 without damage, but still provide a snug, relatively air-tight seal.

As discussed above, an alternative embodiment of the subject invention utilizes a plug comprising a thermoplastic, or similar, material. Thus, in a further preferred alternative embodiment, the hose tip 92 comprises a heating means capable of providing sufficient heat to melt or deform an adequate portion of the plug 76, so as to seal a portion of the air channels 78 therein to prevent unwanted inflow or evacuation of air from a container after the hose tip 92 is removed from the housing 72. The heating means may comprise any of numerous devices known to those with skill in the art. Also, numerous techniques can be used to provide the necessary heat to the heating element 96, including for example, thermal or chemical means. Another option is to equip the subject invention with an intense light, laser or laser-type device capable of melting a plug of thermoplastic or other heat deformable material. Still further embodiments do not require the deformation of the plug, but, rather, deposit a relatively quick-acting sealant material, including for example, cyanoacrylate, UV curable polymers, silicone or polyurethane systems, or film adhesives, tape adhesives, etc., to cover or otherwise seal the air channels.

In a preferred embodiment, a thermal light source, for example a high-intensity bulb, is coupled to the hose tip 92 to provide a heat source. In this embodiment, the plug, or a portion thereof, may further comprise a heat reactive substance capable of being deformed upon sufficient exposure to a thermal light source. In this embodiment, the thermal light source or bulb can, optionally, be replaceable. The configuration, design and composition of this removable tip can vary depending upon which embodiment is used and the intended function, pressurization or evacuation. In a further preferred embodiment, the hose tip 92 further provides a means to isolate and direct the beam of the thermal light source so that the light/heat emitted therefrom is directed only towards or against the plug. Thus, in one embodiment, the high-intensity bulb is surrounded by a heat resistant material, such as, for example, Teflon™. Preferably, the light source is in contact with, or in close proximity to, that portion of the plug 76 that would be deformed to seal the air channels 78.

In an alternative embodiment, the heating means comprises a heating element coupled to the hose tip 92. The heating element 96 may comprise a variety of shapes and sizes, which will depend, ultimately, on the shape and size of the plug 76 used with the subject invention and the placement of the air channels 78 therein. In a further preferred embodiment, the heating element 96 comprises a heat distributor 98 which is fixedly attached to, or contiguous with, the heating element arms 99 via one or more heating element cross-members 97. An example of a preferred heating element 96 having at least two arms 99 extending into and through the hose tip 92 is illustrated in FIGS. 7 and 8. However, it would be well within the skill of a person trained in the art to devise alternative embodiments for the heating element having a variety of different styles and shapes for the heating distributor 98 and cross-members 97 and such alternatives are contemplated to be within the scope of the subject invention.

In a preferred embodiment, an electrical circuit is utilized to heat the heating element 96. It is well known in the art to utilize electrical wires 103 along the length of a hose 100 or other tubing in order to provide a source of electrical current along the length of the hose or tubing and/or to the end of the hose or tubing. It is also well known in the art to control electrical current with any of a variety of switches 91, which may further be positioned on a handle 93. In a further preferred embodiment, the heating element 96 comprises one or more heating element arms 99 that are in contact with one or more electrical wires as a means for providing the heat to the heating element 96. In yet a further preferred embodiment, the heating element arms 99 are embedded in and extend through the hose tip 92 which insulates the exterior of the hose tip from electrical current. FIG. 8 provides an illustration of this alternative embodiment of a hose adaptor 90.

The heating element may comprise a variety of materials capable of being heated or transmitting heat. In a still further preferred embodiment, the heating element comprises a metal capable of conducting electricity. And, in a still further preferred embodiment, the surface of the metal heating element is covered with Teflon™, or a similar non-stick material or chemical, to reduce or prevent the melted plug material from sticking to the heating element 96. Further, as mentioned above and for this alternative embodiment, it may be preferable for the hose tip 92 and/or the housing 72 to comprise materials incapable of conducting an electrical current. Alternatively, it may be possible to utilize a housing 72 and/or hose tip 92 designs that direct the flow of electrical current.

In a still further preferred embodiment, the heating element 96 is removably coupled to the hose tip 92. This allows for the replacement of damaged heating elements 96, or exchange for different styles or types of heating elements. A hose tip comprising a non-electrically conducting material may also be utilized with this hose tip. And, an alternative embodiment utilizes a heating element 96 of non-electrically conducting material, wherein said alternative heating element is capable of being utilized with the first embodiment of the subject invention. Wherein the heating element 96 resembles that of FIG. 4 and is capable of displacing the plug 30 from the port hole 16 of the first embodiment of the subject invention.

The hose tip 54 should be of sufficient length to displace, or deform, the plug 30 or 76 as disclosed in the above embodiments. Thus, the hose tip 54 for each of these embodiments should be inserted a distance sufficient to ensure proper functioning of the hose tip 54 or 92. However, to prevent damage to the plugs 30 or 76, housings 12 or 72, housing openings 16 or 74, or other components of the device, the hose tip 54 should not be inserted an unnecessary or damaging distance into the housing 12. Therefore, a gauge or stop device 52 or 94, for example as shown in FIGS. 4 and 8, can be utilized to ensure that the hose tips 54 or 92 of the embodiments are not inserted beyond the necessary distance. In a preferred embodiment, a stop gauge 52 or 94 is utilized on the hose adaptors 50 and 90 to allow only the required portion of the hose tips 54 and 92 to be inserted into the port hole 16 or housing mouth 74 of the respective embodiments.

The hose adaptors 50 and 90 may also be modified to have various means for gripping or holding the hose adaptors 50 and 90 and/or the vacuum or air hose, both during use and for storage. For example, various types of grooves or grips can be utilized with the hose adaptors 50 and 90. In a preferred embodiment, a rigid or semi-rigid grip 51 or 95 is fixedly attached to the hose adaptors 50 and 90 above the respective stop gauges 52 or 94. This grip 51 can be used for holding or gripping the hose adaptors 50 or 90 during use, and/or as a means for securing the end of the vacuum or air hose 60 or 100 when not in use.

The vacuum or air source utilized with the subject invention can be obtained or created through a variety of methods known to those with skill in the art. As mentioned above, in one embodiment, the device of the subject invention is utilized with standard storage containers or plastic, self-sealing bags generally used for storing food or other relatively small items. Thus, it may only be necessary to have or use a vacuum or air source capable of evacuating or injecting air into such standard, well-known containers. For example, a standard electric vacuum or air pump of sufficient power could be utilized with the subject invention.

It may also be possible to utilize the motor and/or electrical components in an already existing appliance normally utilized in a home, restaurant or business environment. For example, a vacuum pump, air pump, or combination thereof, can be integrally attached to or contained within an already existing countertop appliance or device. The electrical components of the appliance can be made to jointly operate and service the appliance, as well as a pump. This arrangement would also save space because a separate appliance would not be required.

In a preferred embodiment, the components within a standard electric counter-top appliance, for example, but not limited to, a can-opener, blender, mixer, microwave, coffee pot, toaster, timer, clock, etc., are utilized to operate a vacuum or air pressure pump for use with the subject invention. In a further preferred embodiment, the pump is contained within the housing of a said appliance. In a still further preferred embodiment, the motor and/or electrical components of the appliance are modified to jointly operate the existing appliance, as well as the pump to be utilized with the device of the subject invention. In still a further preferred embodiment, a switch connected to the appliance can be used to control, or toggle between, the two or more functions, including the pump, of the appliance.

Following are examples which exemplify certain embodiments of the subject invention. These examples are illustrative and should not be construed as limiting the subject invention in any manner.

Example 1

An embodiment of the device of the subject invention utilizes a rigid circular, essentially hollow, housing approximately 0.5 cm high and 2 cm in diameter. The housing comprises two components, a base and a cap, wherein the base can be inserted into the cap and snap lips on the cap hold the base within the cap. The cap further comprises a circular port hole surrounded by a more pliable material than the main portion of the cap. The port hole is approximately 4-5 mm in diameter. A circular rubber-like plug is utilized within the housing. Further, a circular plug seat approximately 3-4 mm high is fixedly attached to the center of the inside floor of the base.

The device can be provided with a selection of plug styles. After selection of the appropriate plug, the plug is seated within the plug seat, prior to insertion of the base into the cap, to prevent sliding or other movement of the plug within the housing. When the housing is assembled with the plug positioned in the plug seat, the plug extends from the plug seat to the circular port hole, so that the plug can fully occlude the port hole with sufficient tension around the port hole to prevent unwanted intrusion or escape of air. In this embodiment, the plug should be approximately 1.5 cm in diameter at the base and taper towards the port hole to a diameter of approximately 9 to 10 mm. in diameter.

In order for air to be moved into or out of the housing, one or more openings or vents are provided at the bottom end of the base around the perimeter of the plug seat. The vents allow air into or out of the housing. The base of the device is slightly convex so that the vents are not positioned on a flat surface. This can help prevent materials within the container from blocking or interfering with the vents.

The assembled device of the subject invention, is attached to the inside wall of a storage container or storage bag. A concentric strip of sticky adhesive around the perimeter of the port hole, protected by a peel-able paper seal, is utilized to stick the housing to the inside flattened wall of a storage container or storage bag. Either before or after installation of the device, a hole can then be created in the bag above or in the vicinity of the port hole so that the hose tip can be inserted through the hole in the bag and into the port hole. If desired, the hole in the bag can be made by using the hose tip and simply pushing it through the wall of the container and into the port hole, or another device can be utilized that will not damage any other part of the bag, the port hole or the device of the subject invention.

A standard vacuum or air pump can be utilized to evacuate or inject air into the container. However, the subject invention utilizes a specialized vacuum hose adaptor to connect the pump hose to the device of the subject invention. The hose adaptor connects to one end of the pliable vacuum hose, preferably by a tubular projection that is forced into the end of the vacuum hose causing the hose to expand around the tube to form a seal. The opposite end of the hose adaptor has a hose tip. The hose tip is inserted into the port hole to displace the plug from around the port hole. When the vacuum or air pump is turned on, air travels between the vents and the hose tip through the housing.

Example 2

A further embodiment of the subject invention utilizes a housing, as described in Example 1. However, the port hole in this embodiment is surrounded by a stem approximately 3 to 4 mm high from the top of the cap. A hole can be created in the bag or other container prior to installation. The device of the subject invention is positioned inside the container so that the stem around the port hole can be inserted through the hole made in the container, such that the stem protrudes to the outside of the container. The stem is designed to accept a lock washer, wherein the lock washer is pushed over the stem and secured around the stem. Thus, when assembled, the wall of the bag or container is sandwiched between the top of the cap inside the container and the lock washer on the outside of the container. The stem has pawls or one-way teeth that allow the lock washer to be pushed over the stem and prevent the lock washer from being removed from the stem. Further, the pawls or one-way teeth hold the lock washer against the wall of the container securely, so as to form an air-tight seal around the hole through which the stem is protruding from the container.

In this embodiment, the hose tip would need to be longer in order to extend through the stem and displace the plug around the port hole located inside the base of the stem.

Example 3

An alternative embodiment of the subject invention utilizes an essentially tubular housing with a base having an opening in the center of this housing base. A housing collar with an adhesive material thereon surrounds the housing and provides a means for affixing the device to a container. A heat deformable plug is positioned within the opening in the housing base. The shape of the plug is such that a portion of it extends into and occludes the opening, thus providing an air-tight seal, while a further portion of the plug is positioned or "seated" around the periphery of the opening to further seal the opening and prevent the plug from being pushed through the opening in the base of the housing.

The plug further comprises a plurality of channels that extend from about the top of the plug and exit at one or more places from the base of the plug that is located in the opening in the housing base. These channels permit the movement of air into or out of a container when the device is affixed thereto.

A standard vacuum or air pump can be utilized to evacuate or inject air into the container. However, it is important to be able to control the flow of air into or out of a container. Therefore, the subject invention further utilizes a hose adaptor to provide a sufficient seal around the housing and/or air channels to control the flow of air into or out of a container. In addition, the hose adaptor has a hose tip with a further means for sealing the air channels by melting or otherwise deforming the top of the plug within the housing. In this embodiment, an electrical current is provided by wires, preferably positioned along the length of the vacuum or air pump hose such that the standard vacuum or air pump can also provide the electrical current. The hose tip further comprises a heating element connected to the electrical current and controllable by a standard electrical switch, preferably on the handle of the hose. The heating element is in contact with at least a portion of the plug and does not obstruct the flow of air through the air channels in the plug. It is important that the hose adaptor tip is inserted only the required distance into the housing, so that there is no damage to the plug, heating element, etc. Therefore, a stop gauge 94 is utilized on the hose adaptor which allows the hose adaptor tip to be inserted only to a proper depth into the housing.

In use, an opening is made in a container sufficient to accommodate the housing of the device. The housing of the device is inserted through this opening from the inside of the container. The collar surrounding the housing prevents it from being inserted completely through the container opening. Further, the adhesive material on the collar of the housing is affixed to the inside wall of the container to secure the device to the container and provide an air-tight seal around the housing and container opening.

The hose adaptor tip can be inserted a proper distance into the housing mouth from outside the container forming a temporary seal between the hose adaptor and the housing. As desired, air can then be injected into or evacuated from the container. Once the container is adequately inflated or deflated, the switch, or other means, on the hose adaptor can be triggered to allow the flow of electrical current, thus increasing the temperature of the heating element on the hose tip. The hose adaptor should remain within the housing until the heating element has reached sufficient temperature to melt the tip of the plug, thus sealing the ends of the air channels. Once the air channels are sealed, the hose adaptor can be removed from the housing mouth.

Example 4

A further embodiment of the subject invention utilizes a housing, wherein the housing base and the plug are contiguous. Further, the housing, including the plug, comprise a thermoplastic, or similar heat deformable, material. In this embodiment, the plug is essentially a raised or dimple-like protrusion extending upwards from the housing base and into the interior of the housing.

A further embodiment of the hose adaptor has a hose tip thereon with high-intensity bulb affixed within the open end of the hose tip. The hose tip comprises a heat resistant material so that the heat generated by the high-intensity bulb is not able to affect the walls or opening of the housing when the hose tip in placed therein. Instead, the heat of the high-intensity bulb is directed towards the upper surface or tip of the dimple-like plug of which the bulb is in contact or close proximity.

Once a container is appropriately inflated or evacuated, the high-intensity bulb is activated and relatively quickly generates sufficient heat to melt the top of the plug, effectively sealing the ends of the air channels to prevent any further inflation or evacuation of the container. The thermoplastic material of the plug, and the housing, is preferably quick setting, so that once the heat source is removed the plug material quickly sets and seals the air channels.

Example 5

A further embodiment of the subject invention utilizes a housing, as described in Example 3 or Example 4. However, the housing in this embodiment comprises a lock and washer mechanism, wherein the housing is further surrounded by one or more, preferably two or more, pawl teeth designed to accept a lock washer. The pawl teeth are positioned around the housing mouth, above the housing collar. In this embodiment, a lock washer is pushed over the housing mouth and past the pawl teeth, so that it becomes pressed and "locked" against the outside wall of a container to which the device has been attached. Therefore, the distance between the pawl teeth and the housing collar should be sufficient to accommodate the lock washer. Once the lock washer is positioned over and past the pawl teeth, the pawl teeth secure the lock washer against the outside wall of the container such that the wall of the container is sandwiched between the housing collar inside the container and the lock washer on the outside of the container. Further, the pawls or one-way teeth hold the lock washer against the wall of the container securely, so as to form an air-tight seal around the container opening and housing. However, if necessary or desirable, additional sealing means could be utilized in conjunction with the pawl teeth and lock washer.

It should be understood that the examples and embodiments described herein are for illustrative purposes only and that various modifications or changes in light thereof will be suggested to persons skilled in the art and are to be included within the spirit and purview of this application.

What is claimed is:

1. A device for controlling the amount of air within a container, wherein said device comprises:

a housing having one or more walls and a base that define an interior and an exterior, having further at least one first opening between the interior and exterior of the device, and at least one second opening between the interior and exterior of the device, wherein the at least one first opening is for receiving a means for injecting or evacuating air;

a plug contiguous with the housing and comprising at least one sealable air channel there through, wherein the plug occludes the at least one second opening, and wherein the at least one sealable air channel in the plug is contiguous with the second opening and facilitates the movement of air into or out of a container; and a connecting means on the exterior of the housing for connecting the housing to a container, such that the housing is contiguous with the container, and so that an essentially airtight seal is formed between the housing and an opening in the container;

wherein, in use, the housing is fixedly positioned so that the at least one second opening is contiguous with an opening in the container, so that the means for injecting or evacuating air can be inserted into the one or more first openings to move air into or out of the container prior to sealing of the at least one air channel;

and wherein the housing and the plug are each part of a single unit.

2. The device, according to claim 1, wherein the periphery of said housing is essentially circular.

3. The device, according to claim 1, wherein the housing is approximately 0.1 inches to about 0.4 inches tall and approximately 0.4 to about 0.9 inches in diameter.

4. The device, according to claim 1, wherein said housing is approximately 0.125 to about 0.25 inches tall and approximately 0.5 to about 0.625 inches in diameter.

5. The device, according to claim 1, further comprising:

a hose adaptor having a channel there through and at least one first open end and at least one second open end; and a hose tip fixedly connected to at least one end of the hose adapter;

wherein the at least one first open end is connected to a means by which air is actively injected into or evacuated from a container;

and wherein the at least one second open end can be coupled to the at least one first opening of the housing;

and wherein the hose tip is inserted into the at least one first opening of the housing to provide an essentially air-tight seal;

and wherein, when in use, the hose tip does not enter the container.

6. A device for controlling the amount of air within a container, wherein said device comprises:

one or more walls and a base that define an interior and an exterior;

at least one first opening between the interior and exterior of the device, wherein the at least one first opening is for receiving a means for injecting or evacuating air;

at least one second opening between the interior and exterior of the device;

a plug contiguous with the base of the device and comprising at least one sealable air channel there through, wherein the plug occludes the at least one second opening, and wherein the at least one sealable air channel in the plug is contiguous with the second opening and facilitates the movement of air into or out of a container; and a connecting means on the exterior of the device for connecting the device to a container, such that the device is contiguous with the container, and so that an essentially air-tight seal is formed between the device and an opening in the container;

wherein, in use, the device is fixedly positioned so that the at least one second opening is contiguous with an opening in the container, so that the means for injecting or evacuating air can be inserted into the one or more first openings to move air into or out of the container prior to sealing of the at least one air channel.

7. The device, according to claim 6, wherein the periphery of said device is essentially circular.

8. The device, according to claim 6, wherein the device is approximately 0.1 inches to about 0.4 inches tall and approximately 0.4 to about 0.9 inches in diameter.

9. The device, according to claim 6, wherein said device is approximately 0.125 to about 0.25 inches tall and approximately 0.5 to about 0.625 inches in diameter.

10. The device, according to claim 6, further comprising:

a hose adaptor having a channel there through and at least one first open end and at least one second open end; and a hose tip fixedly connected to at least one end of the hose adapter;

wherein the at least one first open end is connected to a means by which air is actively injected into or evacuated from a container;

and wherein the at least one second open end can be coupled to the at least one first opening of the device;

and wherein the hose tip is inserted into the at least one first opening of the device to provide an essentially air-tight seal;

and wherein, when in use, the hose tip does not enter the container.

11. A device for controlling the amount of air within a container, wherein said device comprises:

a housing having one or more walls and a base that define a hollow interior and an exterior, having further at least one first opening between the interior and exterior of the housing, and at least one second opening between the interior and exterior of the housing, wherein the first opening is for receiving a means for actively injecting or evacuating air;

a plug positioned at the base of the interior of said housing having at least one sealable air channel there through, and occluding the second opening in the housing, such that the at least one sealable air channel in the plug is contiguous with the second opening in the housing, and facilitates the movement of air into or out of a container; and a connecting means on the exterior of said housing for connecting said housing to a container, so that an essentially air-tight seal is formed between the housing and an opening in a container for receiving said housing, such that, in use, said housing is fixedly positioned so that the at least one second opening in the housing is contiguous with an opening in the wall of a container, so that said means for injecting or evacuating air can be inserted into the one or more first openings in the housing to move air into or out of a container prior to sealing of the at least one air channel; and wherein the housing and the plug are each part of a single unit.

12. The device, according to claim 11, wherein the periphery of said housing is essentially circular.

13. The device, according to claim 11, wherein the housing is approximately 0.1 inches to about 0.4 inches tall and approximately 0.4 to about 0.9 inches in diameter.

14. The device, according to claim 11, wherein said housing is approximately 0.125 to about 0.25 inches tall and approximately 0.5 to about 0.625 inches in diameter.

15. The device, according to claim 11, further comprising:

a hose adaptor having a channel there through and at least one first open end and at least one second open end; and a hose tip fixedly connected to at least one end of the hose adapter;

wherein the at least one first open end is connected to a means by which air is actively injected into or evacuated from a container;

and wherein the at least one second open end can be coupled to the at least one first opening of the housing;

and wherein the hose tip is inserted into the at least one first opening of the housing to provide an essentially air-tight seal;

and wherein, when in use, the hose tip does not enter the container.

* * * * *